US005916132A

United States Patent [19]

Yoshida et al.

[11] Patent Number: 5,916,132

[45] Date of Patent: Jun. 29, 1999

[54] ENGINE EXHAUST EMISSION CONTROL SYSTEM UTILIZING A CATALYST CARRIED IN A POROUS FLEXIBLE BAG

[75] Inventors: Hiroyuki Yoshida; Toyokazu Kawasaki; Motoyoshi Shishido, all of Wako, Japan

[73] Assignee: Honda Giken Kogyo K.K., Tokyo, Japan

[21] Appl. No.: 08/769,079

[22] Filed: Dec. 18, 1996

[30] Foreign Application Priority Data

Dec. 18, 1995 [JP] Japan ..... 7-328617

[51] Int. Cl.[6] ..... F01N 3/00

[52] U.S. Cl. ..... 60/295; 60/302; 422/170

[58] Field of Search ..... 60/295, 299, 302; 422/170, 171

[56] References Cited

U.S. PATENT DOCUMENTS

| | | | |
|---|---|---|---|
| 3,838,977 | 10/1974 | Warren | 60/302 |
| 3,902,853 | 9/1975 | Marsee et al. . | |
| 3,950,139 | 4/1976 | Cannon | 60/295 |
| 4,735,046 | 4/1988 | Iwai . | |
| 5,239,825 | 8/1993 | Shibata . | |
| 5,419,878 | 5/1995 | Honma | 422/177 |
| 5,431,890 | 7/1995 | Crossland et al. | 422/211 |
| 5,651,249 | 7/1997 | Nagao et al. | 60/302 |

FOREIGN PATENT DOCUMENTS

| | | |
|---|---|---|
| 0 542 002 A2 | 5/1993 | European Pat. Off. . |
| 0 542 002 A3 | 5/1993 | European Pat. Off. . |
| 2145340 | 2/1973 | France . |
| 43 01 286 A1 | 7/1993 | Germany . |
| 4-260893 | 9/1992 | Japan . |
| 6-159054 | 6/1994 | Japan . |

OTHER PUBLICATIONS

Patent Abstract of Japan, vol. 010, No. 365 (M–542), Dec. 6, 1986 & JP 61 160511 A.

*Primary Examiner*—Thomas E. Denion

*Attorney, Agent, or Firm*—Nikaido, Marmelstein, Murray & Oram LLP

[57] ABSTRACT

An engine exhaust emission control system in an outboard engine is provided. The exhaust emission control system has a catalyst unit mounted in an engine block exhaust gas passage in the outboard engine. The catalyst unit comprises a catalyst carrier having at least one catalyst element carried therein and a flexible porous bag having at least a portion of the catalyst therein. The catalyst unit is formed to be positioned within the engine block exhaust passage so as to extend therealong and the catalyst unit is removably inserted and detachably mounted in the exhaust gas passage.

20 Claims, 15 Drawing Sheets

ENGINE EXHAUST EMISSION CONTROL SYSTEM UTILIZING A CATALYST CARRIED IN A POROUS FLEXIBLE BAG

BACKGROUND OF THE INVENTION

1. Field of the Invention

The present invention relates to an exhaust emission control system in an outboard engine for propelling a boat.

2. Description of the Prior Art

There is conventionally known exhaust emission control systems for an outboard engine system, in which a catalyst is mounted in the exhaust system of the engine to purify the exhaust gas by oxidization and reduction (for example, see Japanese Patent Applications Laid-Open Nos. 6-159054 and 4-260893).

In general, in an engine for an outboard engine system, an exhaust passage provided in the engine block of the engine and on a mounting member for mounting of the engine block, may be formed in a straight configuration in a few situations because of limitations in manufacture, structure, function and the like, or may be formed into an inclined configuration, a curved configuration or the like in many cases. Particularly, in a 4-cycle engine, the tendency to define the exhaust passage in an inclined configuration, a curved configuration or the like is great because of the need for defining an oil passage in the engine block of the engine and the need for mounting an oil pan. Further, the shape of the exhaust passage is varied depending upon the form, type and the like of the engine.

SUMMARY OF THE INVENTION

It is an object of the present invention to provide an exhaust system in which the catalyst is easily mounted in the exhaust passage without being governed by the shape of the exhaust passage.

It is another object of the present invention to provide an exhaust system wherein the exhaust gas flows within the catalyst with a small resistance, and the resistance to the exhaust gas is not increased.

It is a further object of the present invention to provide an exhaust system wherein a high-temperature exhaust gas is passed through the catalyst, whereby the purifying reaction of the exhaust gas is promoted.

It is still another object of the present invention to provide an exhaust system wherein the exhaust gas-passing area of the catalyst is increased to enhance the exhaust gas-purifying efficiency.

It is still a further object of the present invention to provide an exhaust emission control system including a small number of parts and having a simple substance structure which can be provided at a lower cost.

It is a further object of the present invention to provide an exhaust emission control system wherein the maintenance is easy.

To achieve the above objects, there is provided an engine exhaust emission control system comprising a catalyst unit mounted in an engine block exhaust gas passage of an engine, wherein the catalyst unit is formed into a cylindrical configuration from a catalyst carrier having a catalyst element carried therein, and a flexible porous bag which contains the catalyst carrier therein, the catalyst unit being deformed so as to extend along and conform to the shape of the engine block exhaust gas passage, and is removably inserted into and detachably mounted in the engine block exhaust gas passage.

The engine block exhaust gas passage comprises an exhaust manifold formed in the engine block, and an exhaust gas communication passage which is formed in a mounting member with the engine block mounted thereon and which communicates with the exhaust manifold. The catalyst unit is inserted into the exhaust gas communication passage formed in the mounting member.

The engine block exhaust gas passage comprises an exhaust manifold formed in the engine block, and an exhaust gas communication passage which is formed in a mounting member with the engine block mounted thereon and which communicates with the exhaust manifold. The catalyst unit is inserted into both of the exhaust gas communication passage formed in the mounting member and the exhaust manifold formed in the engine block.

An engine exhaust emission control system in an outboard engine system is provided which comprises a catalyst unit mounted in an engine block exhaust gas passage in an engine for propelling an outboard engine system, wherein the catalyst unit has a catalyst carrier having a catalyst element carried therein, and a flexible porous bag which contains the catalyst carrier therein, the catalyst unit being formed into a cylindrical configuration which is deformed so as to extend along the shape of the engine block exhaust gas passage, and is removably inserted into and detachably mounted in the engine block exhaust gas passage.

The engine block exhaust gas passage in the engine for the outboard engine system comprises an exhaust manifold formed in the engine block, and an exhaust gas communication passage which is formed in a mounting member, with the engine block mounted thereon and which communicates with the exhaust manifold. The catalyst unit is inserted into the exhaust gas communication passage formed in the mounting member.

The engine block exhaust gas passage in the engine for the outboard engine system comprises an exhaust manifold formed in the engine block, and an exhaust gas communication passage which is formed in the mounting member with the engine block mounted thereon and which communicates with the exhaust manifold. The catalyst unit is inserted into both of the exhaust gas communication passage formed in the mounting member and the exhaust manifold formed in the engine block.

The catalyst unit is secured to an inner wall of the engine block exhaust gas passage.

The engine for propelling the outboard engine system is a 4-cycle engine, and the engine block of the engine is mounted on the mounting member. The oil pan of the engine is integrally supported in a suspended manner on a lower surface of the mounting member, and the engine block exhaust gas passage is in communication with an exhaust gas expansion chamber formed in an extension case connected to a lower portion of the mounting member.

The catalyst carrier is formed of a flexible cylindrical member made of threads formed into a net-like configuration, with a catalyst element being carried in the catalyst carrier. Further, the catalyst carrier is formed of a metal porous member such as Ni whose skeleton is a sponge-like, three-dimensional, mesh configuration, with a catalyst element being carried in the catalyst carrier.

The flexible porous member is formed by fastening an opened base end of the bag-like mesh cover to a mounting plate.

The catalyst unit may be formed of a plurality of catalyst carrier simple substances longitudinally arranged in a flexible manner and covered with a flexible porous bag. More particularly, the catalyst unit is formed of a plurality of catalyst carrier simple substances which are longitudinally arranged in a flexible manner such that a cross section of the catalyst carrier simple substance is smaller in diameter than that of the lower located catalyst carrier simple substance, the catalyst carrier simple substances being covered with a flexible porous bag.

The catalyst unit is formed of a plurality of catalyst carrier simple substances longitudinally arranged in a flexible manner and covered with a flexible porous bag which has neck members formed at locations corresponding to connection boundaries of the plurality of catalyst carrier simple substances.

DETAILED DESCRIPTION OF THE PREFERRED EMBODIMENTS

The mode of the present invention will now be described by way of embodiments of the present invention shown in the accompanying drawings. In the following description of the embodiments, the term "flexible" means a nature that a member is freely deformable, and after deformed, the member maintains the deformed shape and is slightly resiliently restorable, unless an external force is applied to the member.

A first embodiment of an exhaust emission control system the present invention practically applied to an engine in an outboard engine system will be first described with reference to FIGS. 1 to 12.

Figure 1:
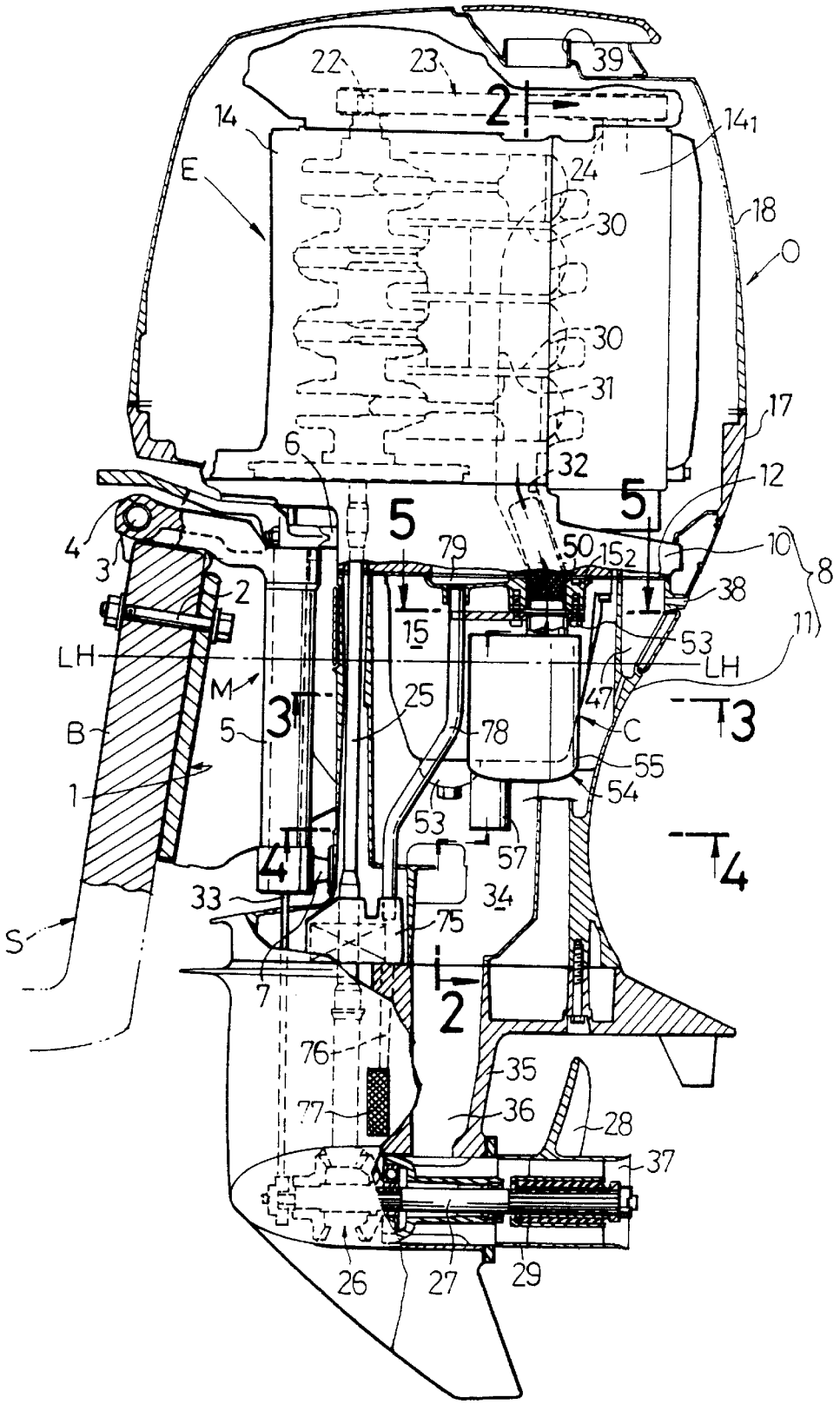
FIG. 1 is a vertical sectional side view of an outboard engine system equipped with a system according to the present invention.
Figure 2:
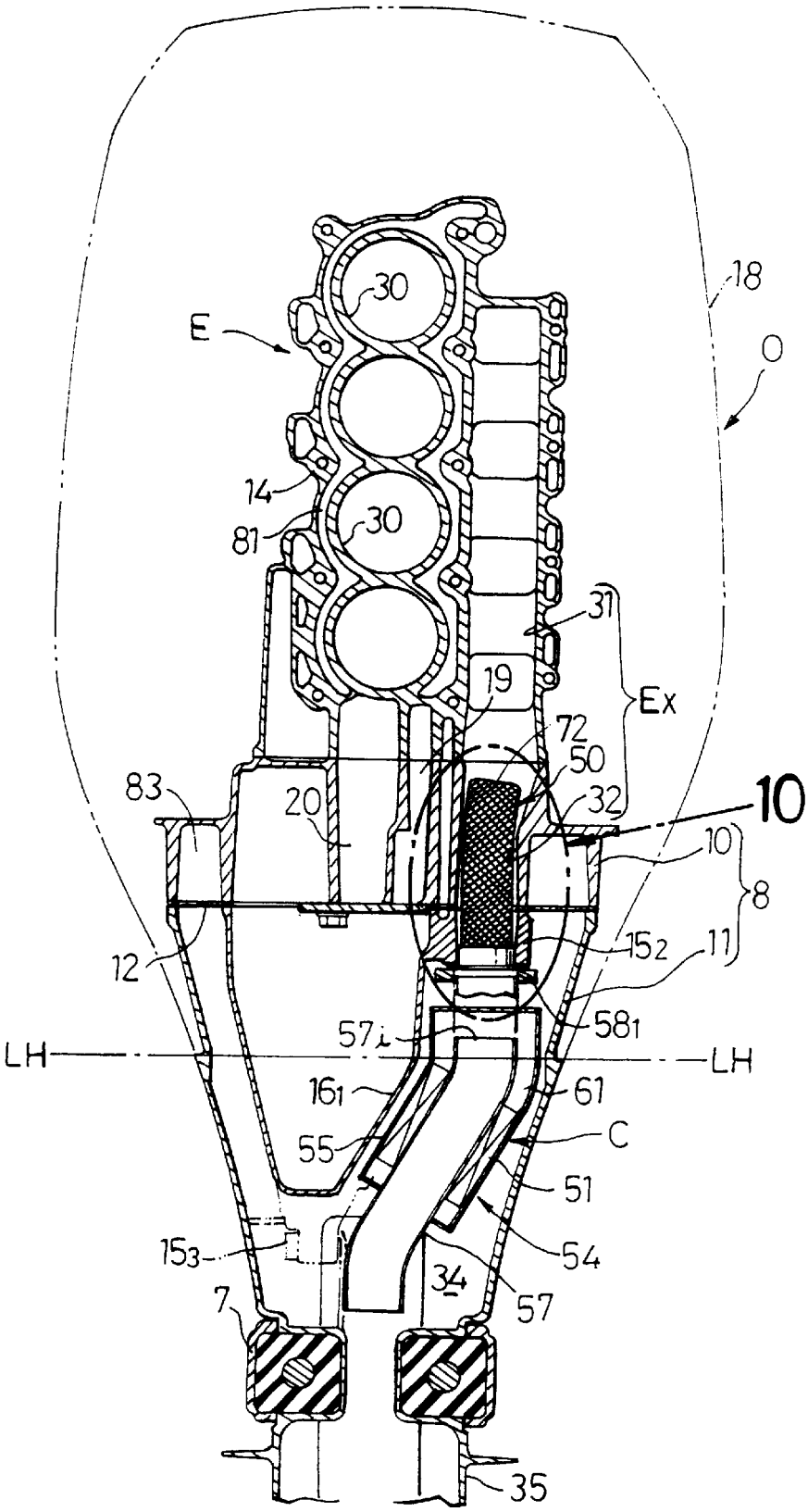
FIG. 2 is a partially vertical sectional view of the outboard engine system taken along the line 2—2 in FIG. 1.

Referring to FIGS. 1 and 2, an outboard engine system O is detachably mounted to a stern B of a boat body S through a mounting device M. The mounting device M includes a stern bracket 1 detachably mounted to the stern plate B by a mounting bolt 2, and a swivel mount 4 which is pivotally mounted for vertical swinging movement to the stern bracket 1 through a tilting shaft 3 laterally positioned at the front end of the stern bracket 1. A vertically extending swivel shaft 5 is rotatably mounted on the swivel mount 4, and a housing 8 of the outboard engine system O is mounted on the swivel shaft 5 through an upper mount 6 and a lower mount 7. Thus, the outboard engine system O can be vertically swung about the tilting shaft 3 and laterally turned about a vertical axis of the swivel shaft 5.

The structure for mounting of the outboard engine system to the boat body S is a conventional, well known structure.

Figure 3:
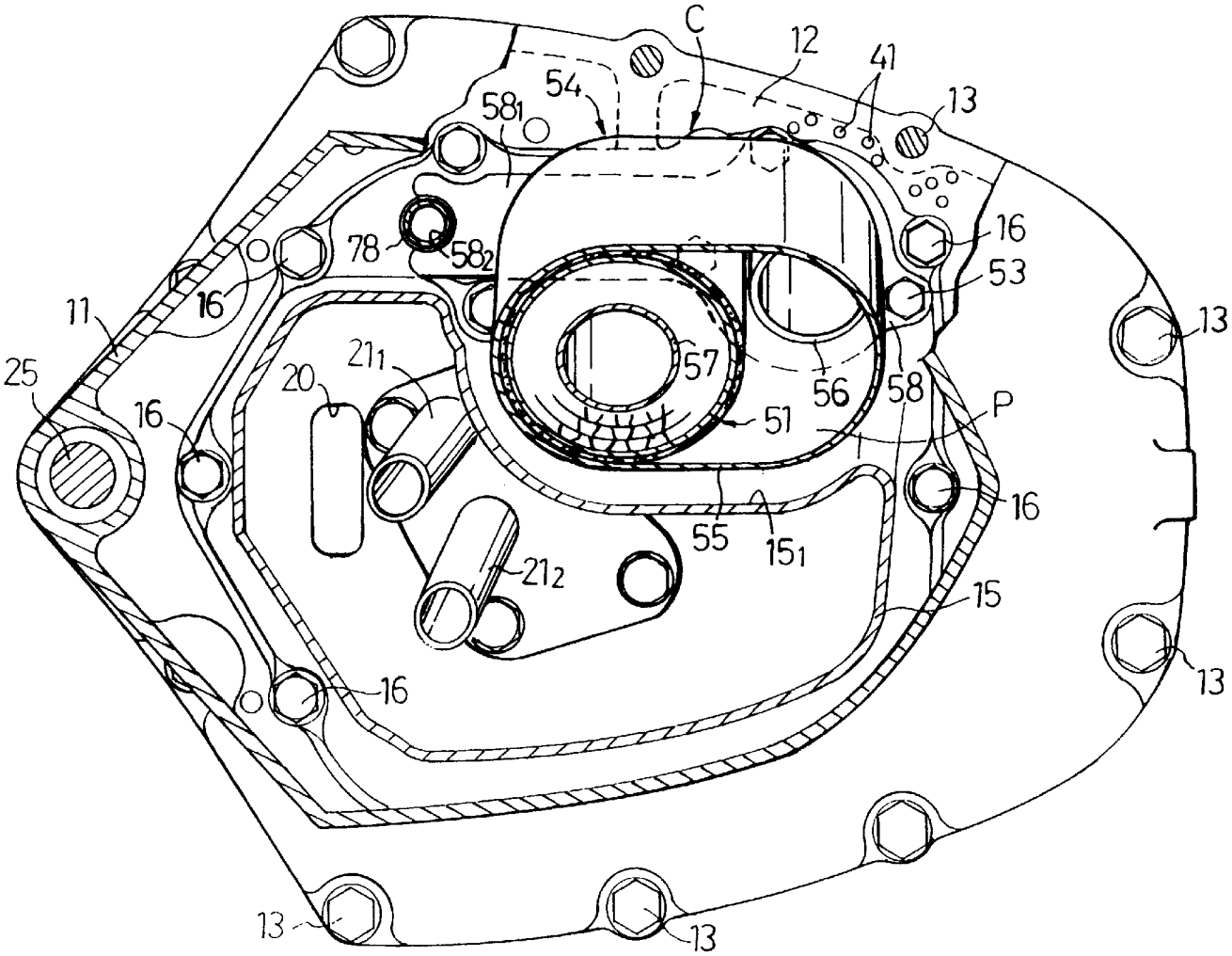
FIG. 3 is an enlarged cross-sectional bottom view of the outboard engine system taken along the line 3—3 in FIG. 1.
Figure 4:
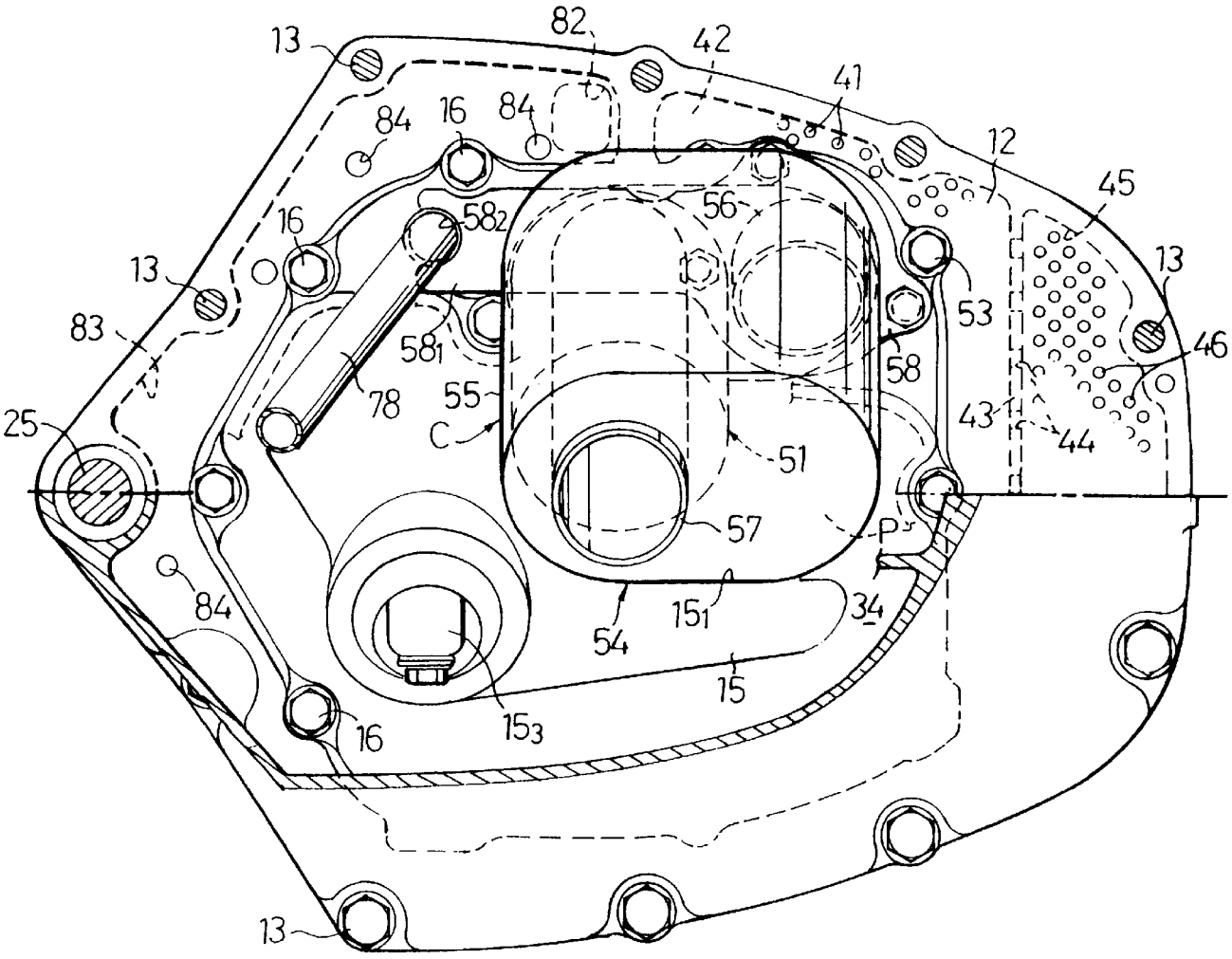
FIG. 4 is an enlarged cross-sectional bottom view of the outboard engine system taken along the line 4—4 in FIG. 1.

The housing 8 of the outboard engine system O includes a mounting member 10 having upper and lower mounting surfaces, and a hollow cylindrical extension housing 11 secured to the lower surface of mounting member 10 with a gasket 12 interposed therebetween by a plurality of bolts 13 (see FIGS. 3 and 4). An engine block 14 of a 4-cycle engine E, made by die-casting, is mounted on the mounting member 10 for driving the outboard engine system in a propelling manner. An oil pan 15 of the engine E is integrally supported in a suspended manner under the mounting member 10 by a plurality of bolts 16 (see FIGS. 3 and 4).

The lower half of the 4-cycle engine E is covered with an under-case 17 connected to the extension housing 11, while the upper half of the engine E is covered with an engine cover 18 detachably coupled to an upper edge of the under-case 17 with a packing interposed therebetween. An air intake 39 is opened in an upper portion of the engine cover 18, so that breathing is performed inside and outside the engine cover 18 through the air intake 39.

The engine E is a water-cooled, 4-cylinder, vertical, 4-cycle type engine, and has a crankshaft 22 which extends vertically in the engine block 14. A cam shaft 24 for driving a valve-operating mechanism of the engine through a belt-type timing and transmitting mechanism 23 is operatively connected to an upper end of the crankshaft 22, and a vertical shaft 25 is connected at its upper end, to a lower end of the crankshaft 22 and extends longitudinally within the housing 8. The vertical shaft 25 is connected at its lower end through a forward and backward movement switching mechanism 26, to a propeller shaft 27 which is connected to a propeller 28. Thus, an output from the engine E is transmitted through the crankshaft 22, the vertical shaft 25, the forward and backward movement switching mechanism 26 and the propeller shaft 27 to the propeller 28. In the drawings 33 is a shifting rod for switching the direction of rotation of the propeller shaft 27.

The oil pan 15 suspendedly supported on the lower surface of the mounting member 10, is formed into a bucket-like shape with a relatively large volume to store oil for lubricating the 4-cycle engine E therein, and is positioned within the extension housing 11. Thus, the oil in the oil pan 15 is supplied through an oil suction pipe $\mathbf{21}_1$ and an oil suction passage 19 (see FIG. 2) to oil supply portions such as a crank chamber, a cam chamber and the like in the engine block 14 by an oil pump which is not shown, and the oil from the engine block 14 is returned through an oil return passage 20 and an oil return pipe $\mathbf{21}_2$ (see FIG. 3) to the oil pan 15.

A recess $\mathbf{15}_1$ is vertically and longitudinally formed near a central portion of a side wall of the extension housing 11, to receive a catalyst case 55 of a catalyst assembly which will be described hereinafter. The recess $\mathbf{15}_1$ is gradually, inwardly deeper and deeper from an upper portion to a lower portion of the oil pan 15, as shown in FIGS. 3 and 4. A drain $\mathbf{15}_3$ is provided sideways in the lower portion of the oil pan 15 and opens laterally toward a side of the extension housing 11. This drain $\mathbf{15}_3$ is provided on the opposite side of the oil pan 15 from the position of a catalyst assembly 54 which will be described hereinafter, with respect to a center line L—L extending longitudinally in the outboard engine system O, so that mutual interference can be avoided.

An exhaust system including primary and secondary catalyst units 50 and 51 in the 4-cycle engine E will be described below. An exhaust manifold 31, at which exhaust ports of four cylinders 30 join together, is formed vertically along the direction of arrangement of the cylinders 30 in a cylinder head $\mathbf{14}_1$ of the engine block 14. An opened lower end of the exhaust manifold 31 is in communication with an exhaust passage 32 which is defined in the mounting member 10 and an extension $\mathbf{15}_2$ of a mounting flange of the oil pan 15. An engine block exhaust passage Ex is formed by the exhaust manifold 31 and the exhaust communication passage 32. A lower surface of the exhaust passage Ex opens into the extension housing 11, and a primary catalyst unit 50 of the catalyst assembly C which will be described hereinafter is inserted into the exhaust passage Ex. The catalyst assembly C has a secondary catalyst unit 51 whose outlet opens into an exhaust gas expansion chamber 34 formed in a lower portion of the extension housing 11. The exhaust gas expansion chamber 34 is also in communication with the outside through a main exhaust gas passage 36 defined in a gear case 35 connected to a lower surface of the extension case and through a main exhaust gas outlet 37 defined within a propeller boss 29 integral with the propeller 28. The inside of the exhaust gas expansion chamber 34 is also in communication with a subsidiary exhaust gas outlet 38 which opens into an upper portion of a back surface of the extension housing 11. More specifically, as shown in FIG. 4, the exhaust gas expansion chamber 34 is in communication with a first subsidiary exhaust gas passage 42 defined in a lower surface of the mounting member 10 through a large number of first small bores 41 which open through the gasket 12. Further, the first subsidiary exhaust gas passage 42 is in communication with a second subsidiary exhaust passage 45 defined in the lower surface of the mounting member 10 through a through-hole 44 made in a partition wall 43. The second subsidiary exhaust passage 45 is also in communication with the subsidiary exhaust gas outlet 38 through a large number of second small bores 46 which open through the gasket 12 and through a subsidiary exhaust gas chamber 47 (see FIG. 1).

An exhaust gas generated by the operation of the 4-cycle engine E flows from the exhaust manifold 31 through the exhaust passage 32 into the catalyst assembly C (which will be described hereinafter) having the first and second catalyst units 50 and 51 incorporated therein, where harmful components such as $NO_x$, CO, HC and the like are oxidized and reduced. Thereafter, the purified exhaust gas flows into the exhaust gas expansion chamber 34, and a portion of the exhaust gas in the exhaust gas expansion chamber 34 is passed through the main exhaust gas passage 36 and the main exhaust gas outlet 37 and released to the outside. Further, the remaining exhaust gas is passed through the first small bores 41, the first subsidiary exhaust gas passage 42, the through-hole 4, the second subsidiary exhaust gas passage 45, the second small bores 46 and the subsidiary exhaust gas chamber 47 and released to the outside.

The specific structure of the catalyst assembly C will be described below with reference to FIGS. 5 to 12 in addition to FIGS. 1 to 4.

The catalyst assembly C includes a vertical-type primary catalyst unit 50 and a secondary catalyst unit 51. The primary and secondary catalyst units 50 and 51 may be of same type or of different types. For example, the vertical-type primary catalyst unit 50 may be a platinum catalyst also serving as an auxiliary catalyst for reducing harmful components such as $NO_x$ and the like. Alternatively, the primary and secondary catalyst units 50 and 51 may be ternary catalysts, so that secondary air or the like can be introduced immediately in front of the downstream secondary catalyst unit 51 to oxidize harmful components such as HC, CO and the like.

The primary and secondary catalyst units 50 and 51 may be of any type employed depending upon the degree of purification of the exhaust gas.

Figure 11:
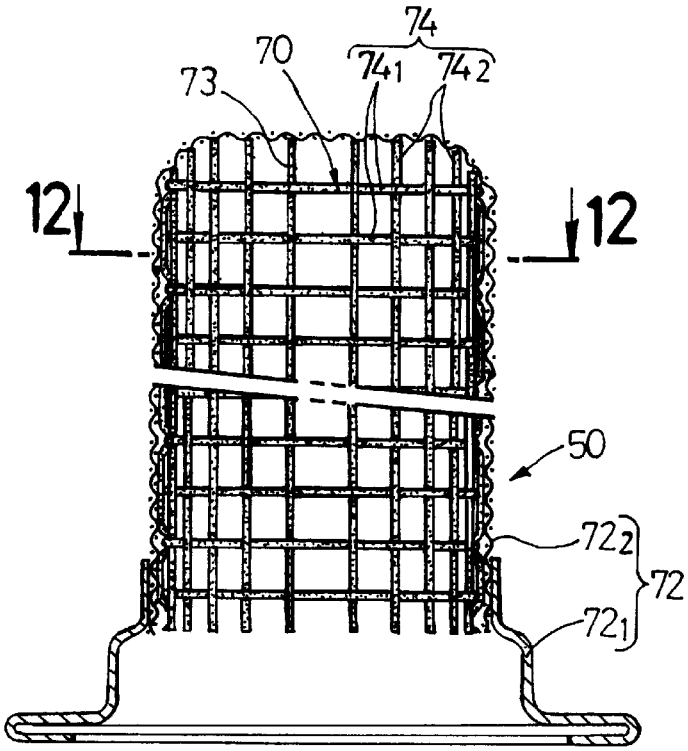
FIG. 11 is a vertical sectional view of a primary catalyst unit.
Figure 12:
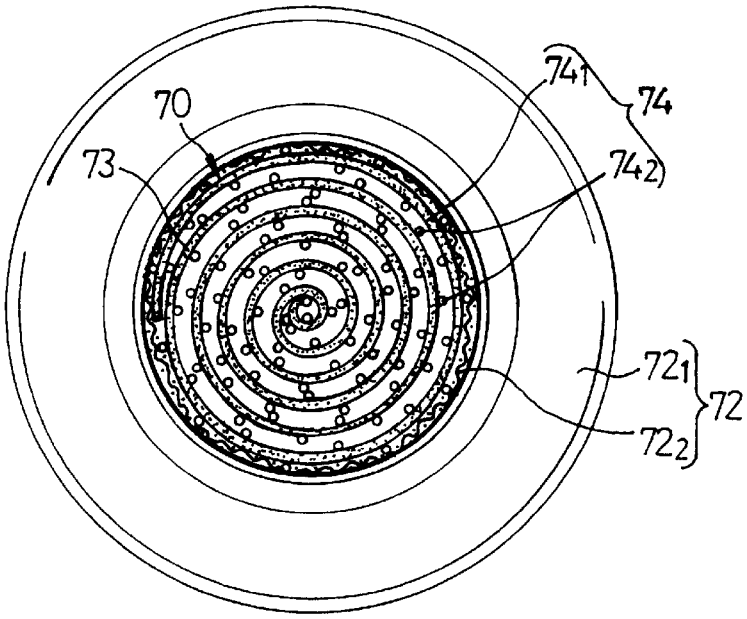
FIG. 12 is a cross-sectional view of the primary catalyst unit taken along the line 12—12 in FIG. 11.

The primary catalyst unit 50 is formed into an elongated cylinder-like configuration, and it is freely deformable as a whole and in a free state, it is maintained in a predetermined shape. The primary catalyst unit 50 is formed from a catalyst carrier 70 having a catalyst element such as an alumina wash coat carried thereon, and a flexible porous bag 72 which contains the catalyst carrier 70 therein. As best shown in FIGS. 11 and 12, the catalyst carrier 70 is formed into a lattice-like cylindrical member 74 whose corners are rounded and which is comprised of a plurality of weft threads $\mathbf{74}_1$ wound in a swirl form and laterally arranged in a row at a distance from each other, and a plurality of straight warp threads $\mathbf{74}_2$ coupled to the weft threads at distances to cross the weft threads. The weft and warp threads $\mathbf{74}_1$ and $\mathbf{74}_2$ are formed into the cylindrical member 74, and after such formation, the catalyst element 73 is placed in the cylindrical member 74.

The weft and warp threads $\mathbf{74}_1$ and $\mathbf{74}_2$ may be made by knitting or weaving.

The porous bag 72 is formed by securing a lower opened end of a flexible mesh, heat resistant cover $\mathbf{72}_2$, such as a stainless steel mesh cover, to an annular mounting plate $\mathbf{72}_1$.

The primary catalyst unit 50 formed in the above manner is inserted into the exhaust gas communication passage 32 formed adjacent the extension $\mathbf{15}_2$ of the oil pan 15 through the bottom surface of the communication passage 32 within the extension housing 11. In this case, a reaction area of the primary catalyst unit 50 can be freely, plastically, deformed by applying an external force and hence, can be deformed to extend along the contour of the exhaust gas communication passage 32, whereby the primary catalyst unit 50 can be simply and easily inserted into the exhaust gas communication passage 32. Thus, a predetermined gap can be maintained between the primary catalyst unit 50 and the exhaust gas communication passage 32. Moreover, the primary catalyst unit 50 cannot be deformed by the back pressure of the exhaust gas. The mounting plate $\mathbf{72}_1$ of the primary catalyst unit 50 has a flange portion which is clamped between the extension $\mathbf{15}_2$ and a mounting flange 58 of a catalyst case 54 (which will be described hereinafter) of the secondary catalyst unit 51 and is fixed along with the catalyst case 54 to the extension $\mathbf{15}_2$ of the oil pan 15 by a plurality of bolts 53 (see FIG. 1).

Figure 10:
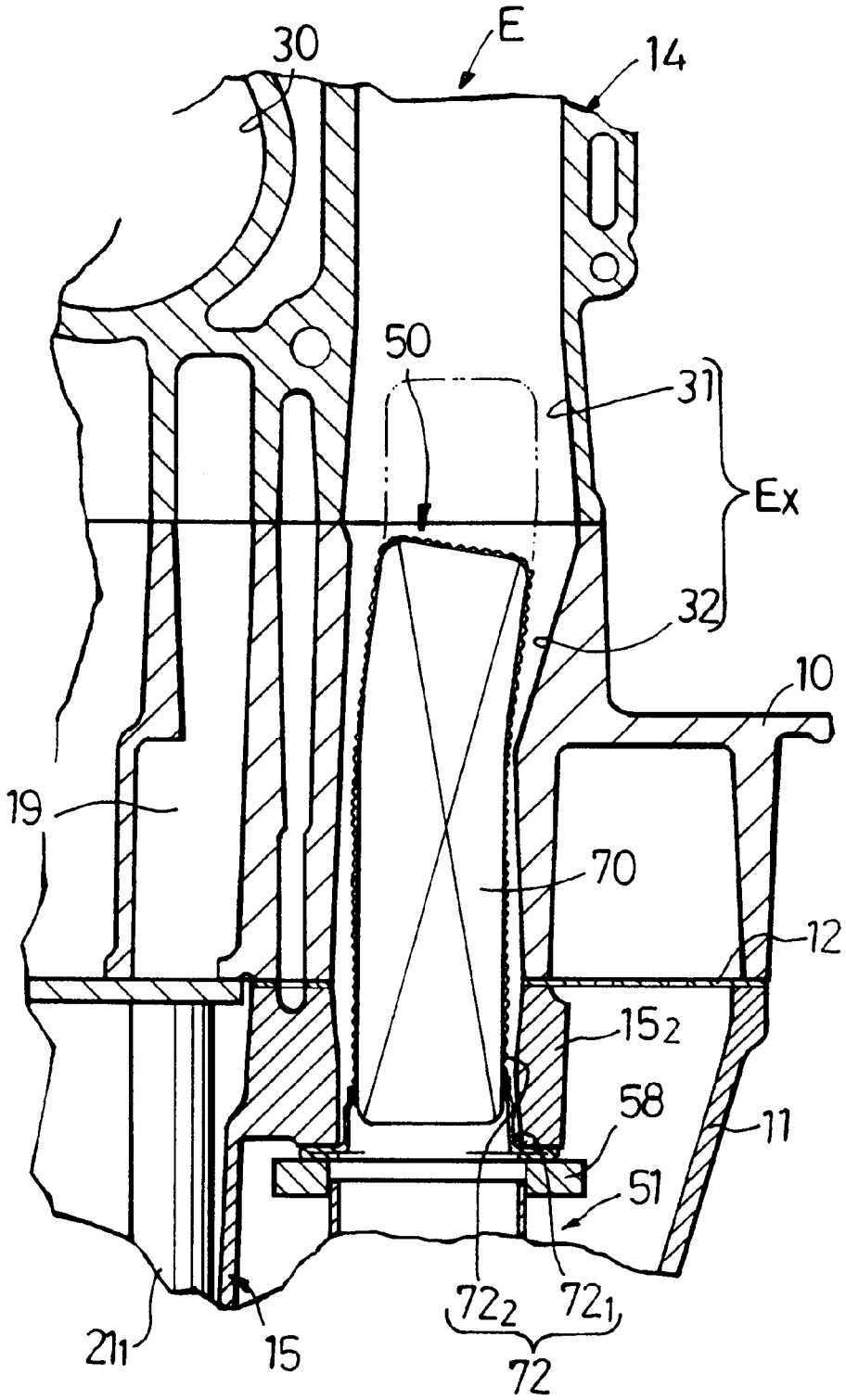
FIG. 10 is an enlarged view of a portion indicated by the arrow 10 in FIG. 2.

The primary catalyst unit 50 may be extended to the exhaust manifold 31 of the engine block 14, as shown by a dashed line in FIG. 10.

A high-temperature exhaust gas generated by the operation of the engine E flows from the exhaust manifold 31 into the exhaust gas communication passage 32 and vertically within the primary catalyst unit 50, where harmful components such as $NO_x$, CO, HC and the like are primarily reduced and oxidized. The exhaust gas then flows into the secondary catalyst unit 51 (which will be described hereinafter). Therefore, the area of contact of the exhaust gas with the catalyst carrier 70 can be increased by flowing of the exhaust gas with less resistance in a vertical direction within the catalyst carrier 70 formed as described above. Thus, it is possible to reduce the resistance to the flow of the exhaust gas and moreover, to enhance the purifying efficiency.

The catalyst assembly 54 of the primary and secondary catalyst units 50 and 51 may be directly attached to the lower surface of the mounting member 10.

Figure 9A:
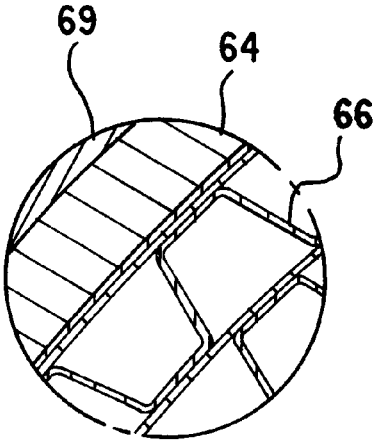
FIG. 9 is a vertical sectional view of the catalyst assembly taken along the line 9—9 in FIG. 8.
Figure 9:
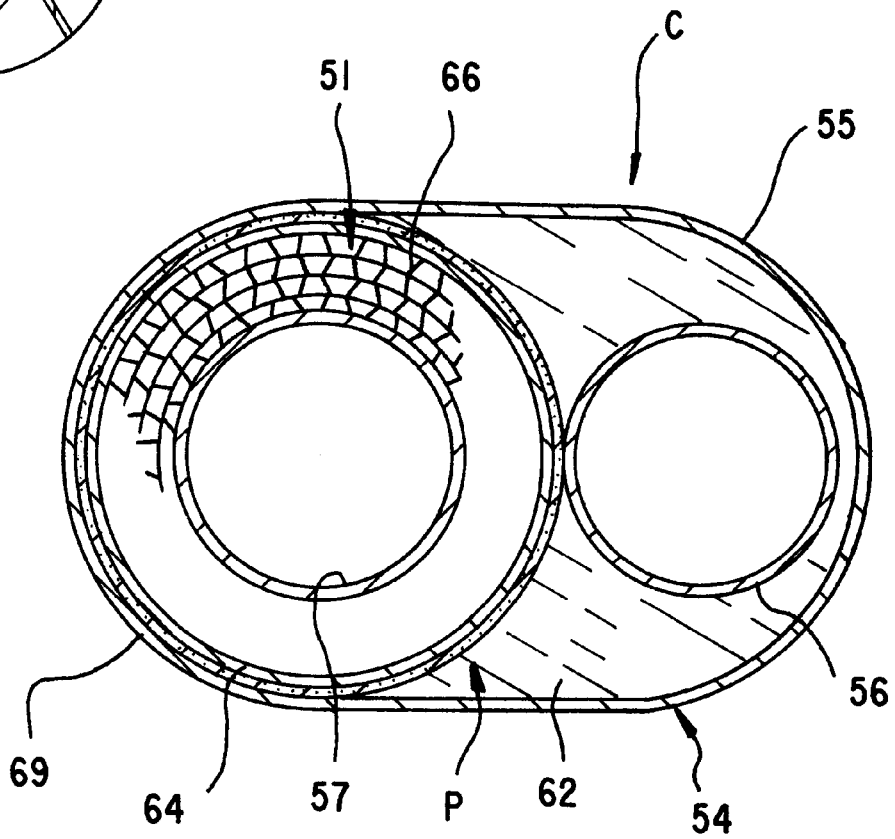

The construction of the secondary catalyst unit 51 will be described with reference to FIGS. 5 and 9 in addition to FIGS. 1 to 4.

The catalyst assembly 54 of the secondary catalyst unit 51 has a closed catalyst case 55 which is formed into a substantially elliptic flat shape, in cross section, with a relatively large volume and comprises a top wall 55*t*, a bottom wall 55*b* and a side wall 55*w*, an exhaust gas introduction pipe 56 inserted into the catalyst case 55 through the top wall 55*t* at a location near one side, and an exhaust gas discharging pipe 57 inserted into the catalyst case 55 through the bottom wall 55*b* at a location near the other side. As shown in FIGS. 3 and 4, the catalyst assembly 54 is inclined inwardly from the top toward the bottom within the extension housing 11 and is juxtaposed in proximity to the oil pan 15, with at least a portion of the catalyst assembly 54 being received in the recess $\mathbf{15}_1$ defined in the side wall of the oil pan 15. On the whole, the catalyst assembly 54 and the oil pan 15 are compactly accommodated within the extension housing 11 without any partial protrusion.

Figure 7:
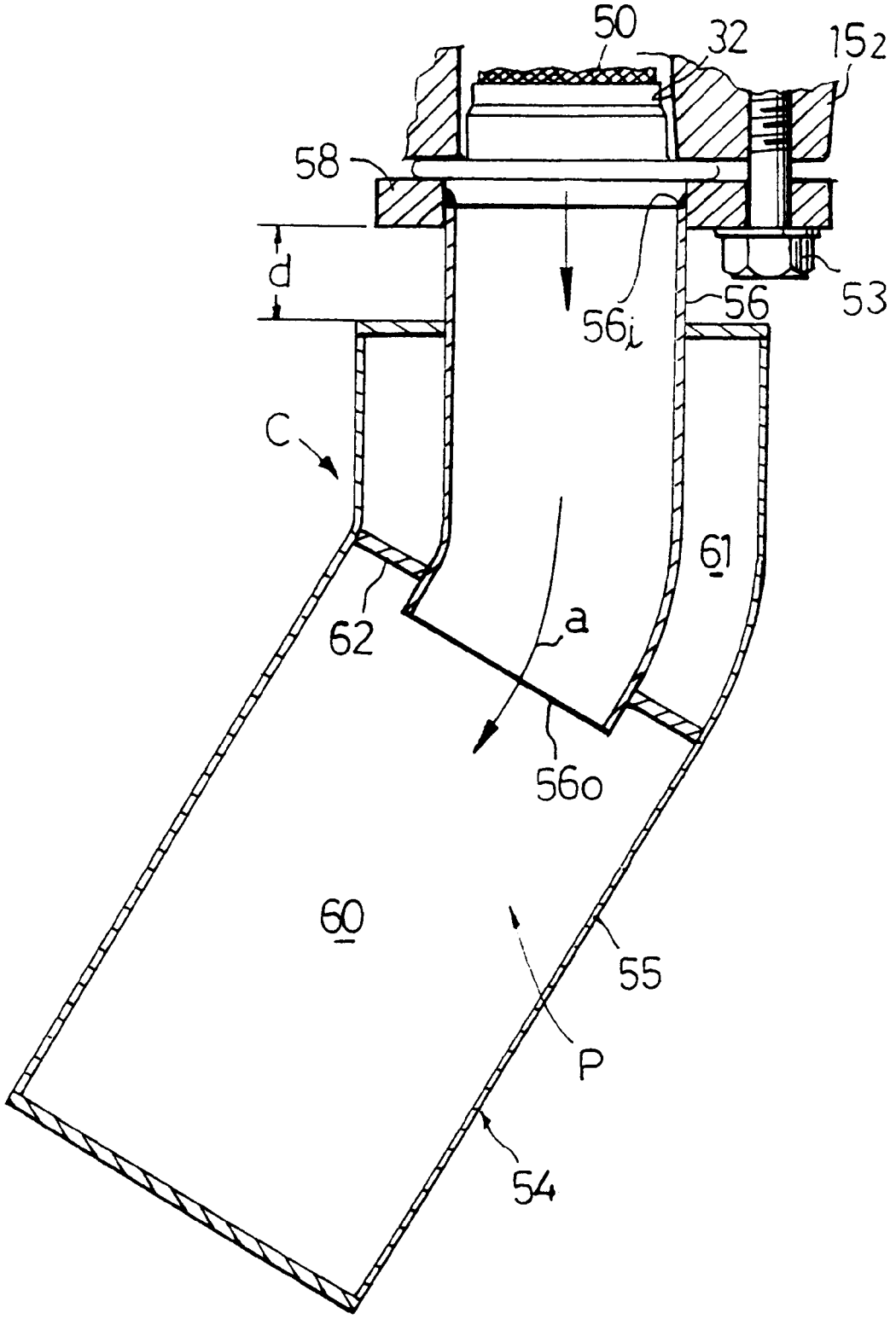
FIG. 7 is a vertical sectional view of the catalyst assembly taken along the line 7—7 in FIG. 5.

A mounting flange 58 is secured to an upper end 56*i* of the exhaust gas introduction pipe 56 and also secured along with the primary catalyst unit 50 to the lower surface of the extension $\mathbf{15}_2$ of the oil pan 15 by the plurality of bolts 53, as shown in FIG. 7. Thus, the catalyst assembly 54 is integrally supported in a suspended manner on the mounting member 10. A gap d of a predetermined width is defined between the mounting flange 58 and an upper surface of the catalyst case 55 to facilitate the mounting of the catalyst assembly 54.

Figure 8:
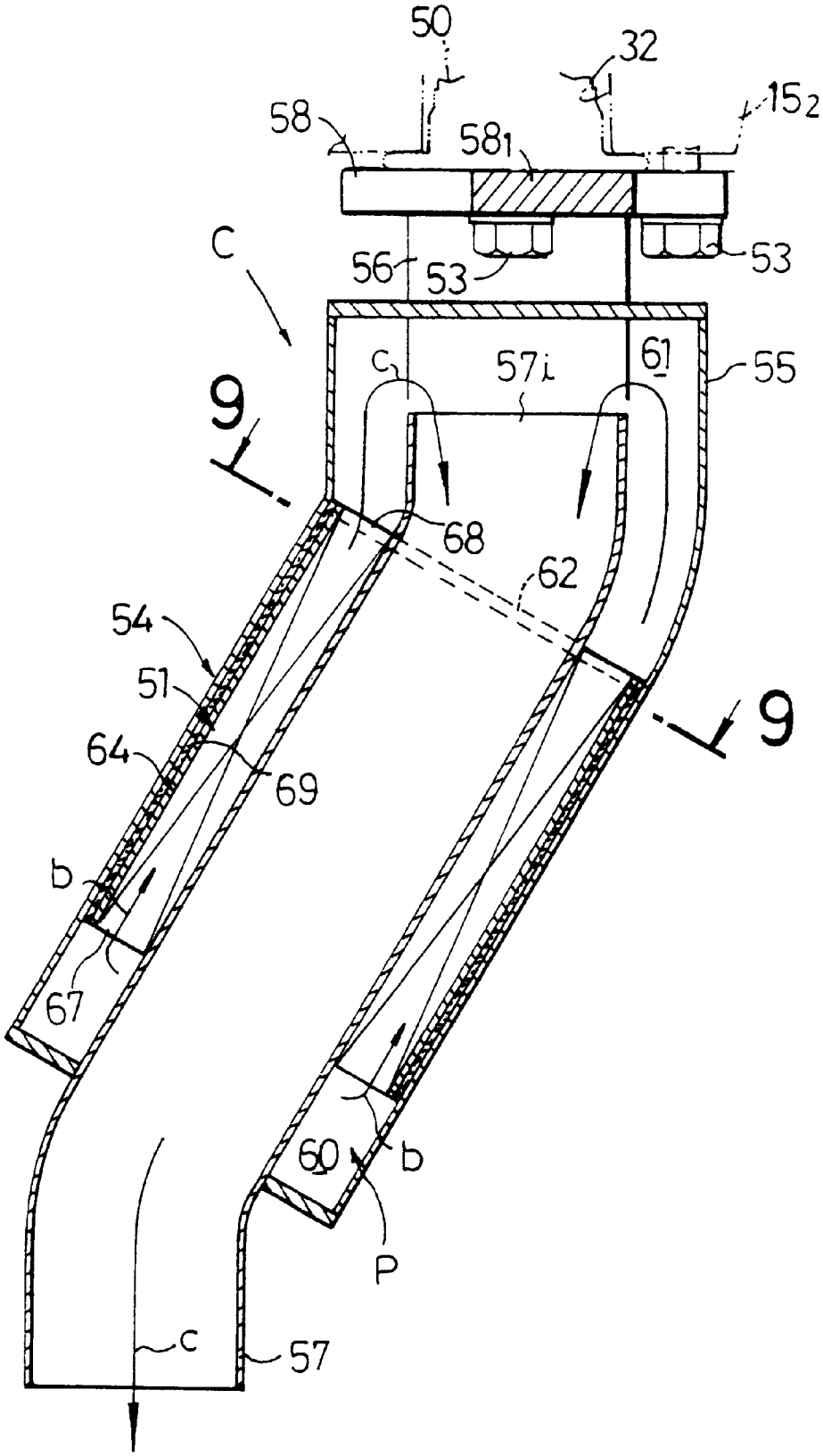
FIG. 8 is a vertical sectional view of the catalyst assembly taken along the line 8—8 in FIG. 5.

The exhaust gas introduction pipe 56 extends to the middle of the catalyst case 55 and is secured at its inner end to a partition wall 62 for partitioning the inside of the catalyst case 55 into a first chamber 60 and a second chamber 61, by welding or the like, as best shown in FIG. 7. An outlet 56*o* of the exhaust gas introduction pipe 56 communicates with the first chamber 60. As best shown in FIG. 8, the exhaust gas discharging pipe 57 is bent into an S-shape and extends longitudinally within the first chamber 60 and through the partition wall 62 to reach near the upper end of the catalyst case 55. The exhaust gas discharging pipe 57 has an inlet 57*i* which communicates with the second chamber 61, and an outlet 57*o* which is extended to the outside.

Figure 5:
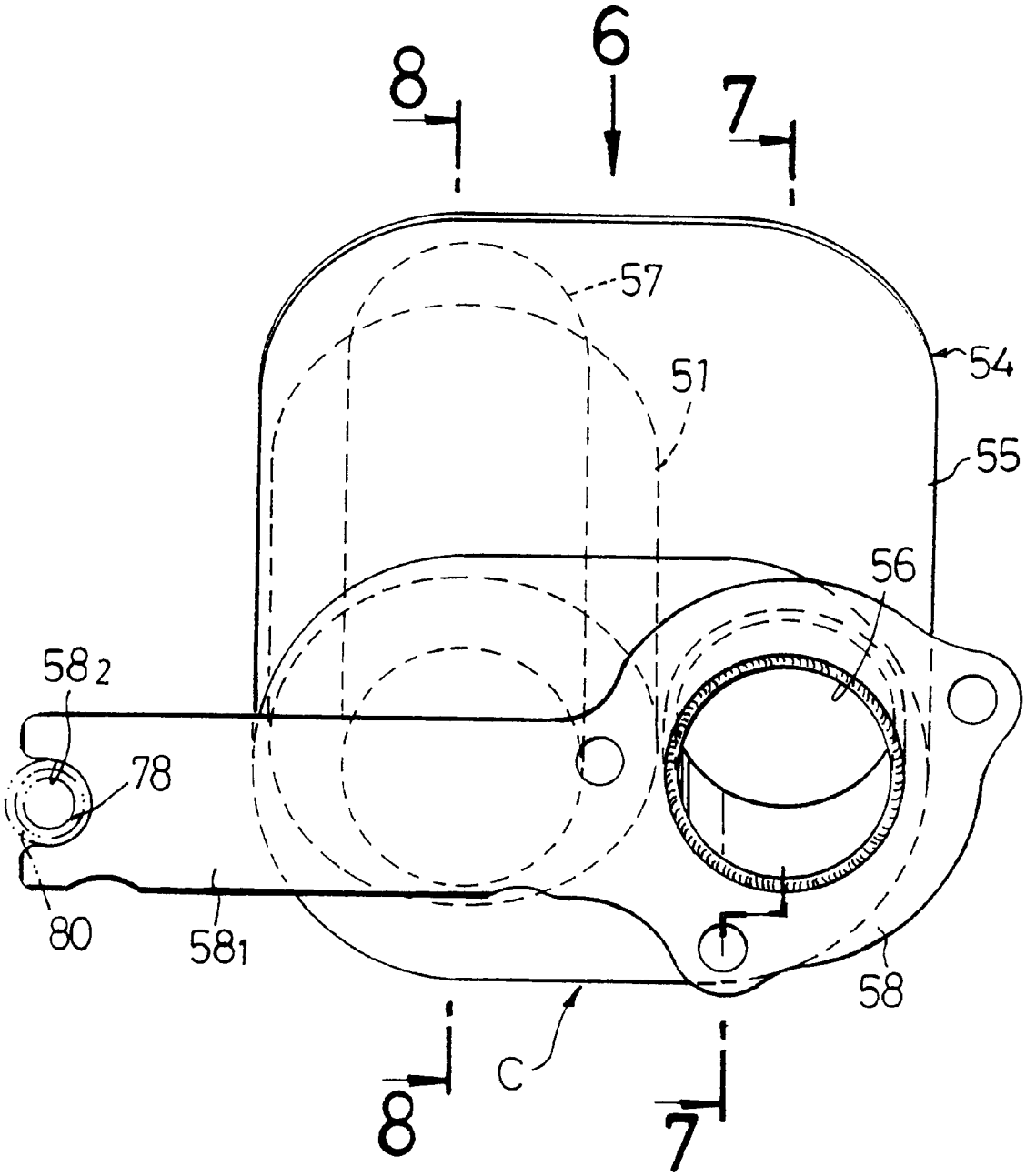
FIG. 5 is a plan view of a catalyst assembly of the present invention taken along the line 5—5 in FIG. 1.
Figure 6:
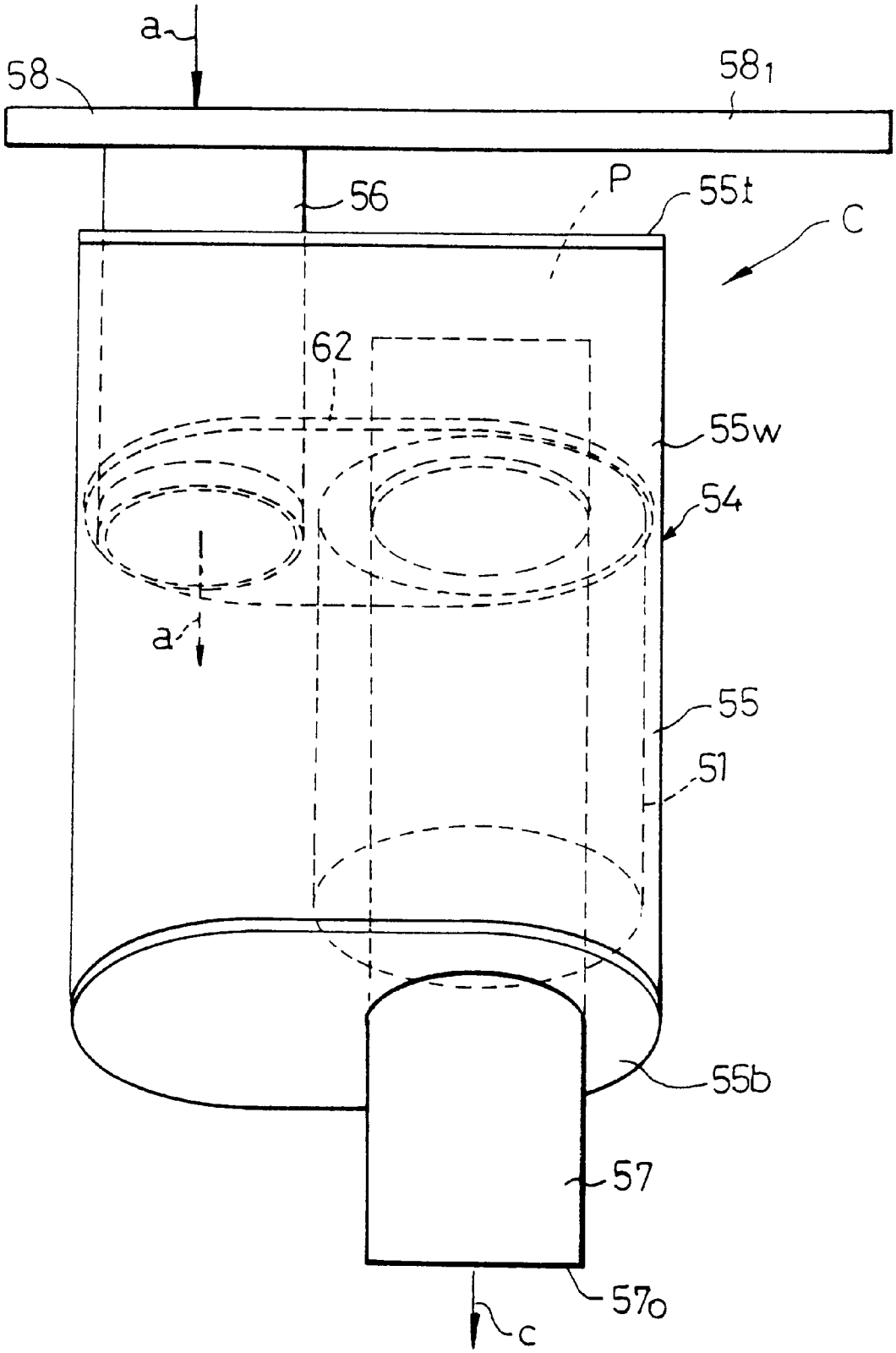
FIG. 6 is a side view of the catalyst assembly taken in a direction of the arrow 6 in FIG. 5.

As best shown in FIG. 5, an arm is integrally provided on the mounting flange 58 to extend therefrom sideways of the oil pan 15. A semi-circular engage portion $\mathbf{58}_2$ is formed at a free end of the arm $\mathbf{58}_1$ for engagement with a middle portion of a water discharge pipe 78 (which will be described hereinafter) in order to retain the water discharge pipe 78.

The secondary catalyst unit 51 cylindrically formed, is secured to an outer periphery of the exhaust gas discharging pipe 57 within the first chamber 60 by brazing to be able to withstand a high-temperature condition. The secondary catalyst unit 51 is comprised of a cylindrical outer shell 64 and a catalyst carrier 66 of a honeycomb structure having a catalyst element interposed between the outer shell 64 and the exhaust gas discharging pipe 57, as shown in FIGS. 8 and 9. The secondary catalyst unit 51 has an inlet 67 provided at one end thereof and communicates with the first chamber 60, and an outlet 68 provided at the other end thereof passes through the partition wall 62 to communicate with the second chamber 61. A heat-insulating material 69 is wound around an outer periphery of the secondary catalyst unit 51, with outer half of the heat-insulating material 69 being closely bonded to an inner surface of the catalyst case 55.

Exhaust gas from the engine E passes through the exhaust manifold 31 and the exhaust passage 32 into the vertical-type primary catalyst unit 50, where the exhaust gas is primarily purified, and then, it passes into the secondary catalyst unit 51. Within the secondary catalyst unit 51, the exhaust gas flows downward from the exhaust introduction pipe 56 to enter the first chamber 60, as indicated by an arrow a in FIG. 7. The exhaust gas reverses its course in the first chamber 60, to flow upwardly into the secondary catalyst unit 51, as shown by an arrow b in FIG. 8, where it is secondarily purified. Thereafter, the gas flows into the second chamber 61, where it further reverses its course to flow downwards again into the exhaust gas introduction pipe 57, as shown by an arrow C in FIG. 8 and then flows into the exhaust gas expansion chamber 34 within the extension housing 11. In the above manner, the exhaust gas flows within an exhaust gas purifying passage P defined within the catalyst assembly case 54, while being expanded by the discharging from the exhaust gas introduction pipe 56 and constricted by flowing into the exhaust gas discharging pipe 57, wherein the expansion and constriction are repeated. For this period of time, the exhaust noise is effectively attenuated and at the same time, the exhaust gas is effectively purified by the secondary catalyst unit 51 maintained at a proper temperature by the heat of the exhaust gas. The immersion of secondary catalyst unit 51 into the water is reduced by the fact that the inlet 57*i* of the exhaust gas discharging pipe 57 is disposed above the secondary catalyst unit 51.

A water draft line LH—LH is shown in FIGS. 1 and 2, lies at an upper location when the outboard engine system is at rest.

Returning again to FIGS. 1 and 2, a water pump 75 is disposed near a front portion of the extension housing 11 and is driven by the vertical shaft 25. A water suction pipe 76 is connected to the suction port of the water pump 75 and extends downward into the gear case 35, and a strainer 77 is connected to a lower end of the water suction pipe 76. A water discharge pipe 78 is connected to the discharge port of the water pump 75 and extends upwards within the extension housing 11. An upper end of the water discharge pipe 78 communicates with a water supply passage 79 which is defined in the flange portion of the oil pan 15. Alternatively, the water supply passage 79 may be formed in the mounting member 10.

An upper portion of the water discharge pipe 78 is engaged with and retained on the engage portion $\mathbf{58}_2$ at the tip end of the arm $\mathbf{58}_1$ which is extended from the mounting flange 58, as described above. The water supply passage 79 communicates with an inlet of a water jacket 81 which is defined in the engine block 14 and whose outlet communicates with a water return passage 82 (see FIG. 4) extending through the mounting member 10. The water return passage 82 opens into a cooling-water passage 83 which is defined by the recess made in the lower surface of the mounting member 10 and the gasket 12, and a plurality of small water discharge bores 84 are made in the gasket 12 for permitting the cooling-water passage 83 to communicate with the outside of the oil pan within the extension housing 11.

When the water pump 75 is driven by the operation of the engine E, water stored in the gear case 35 is pumped through the strainer 77 and the suction pipe 76; pressurized by the water pump 75 and passed into the water jacket 81 in the engine block 14 to cool the engine block 14. After cooling of the engine block 14, the water is passed from the outlet of the water jacket 81 through the water return passage 82 into the cooling-water passage 83 and then through the plurality of small water discharge bores 84 to become a mist, which drops to the periphery of the oil pan 15 within the extension case to effectively cool the oil pan 15.

Figure 13:
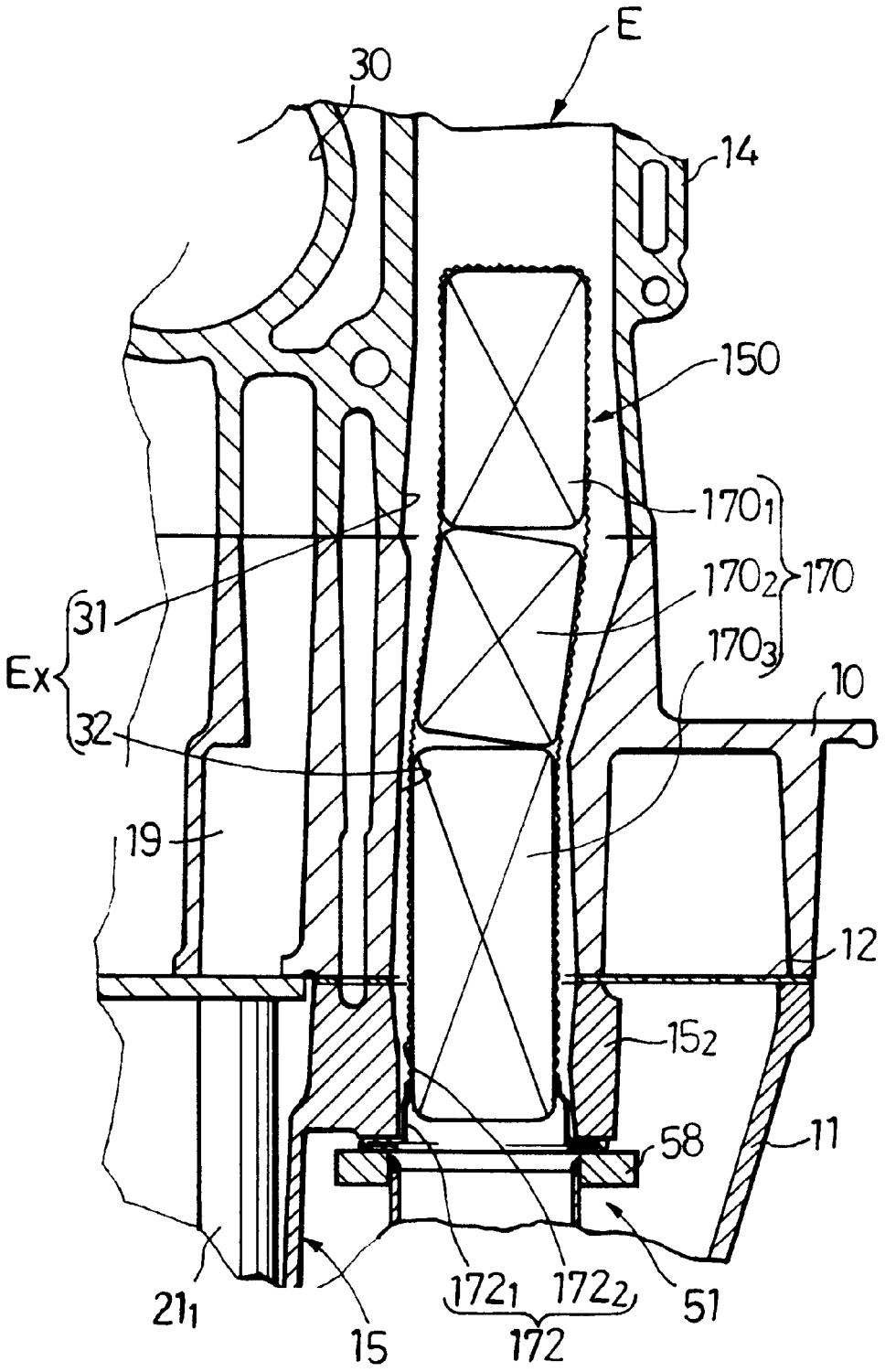
FIG. 13 is a vertical sectional view of a second embodiment of a portion of the outboard engine system at which a primary catalyst unit is mounted.

A second embodiment of the present invention will now be described with reference to FIG. 13, wherein the same members or portions as those in the first embodiment are designated by like reference numbers.

The second embodiment is slightly different from the first embodiment in respect of the structure of the primary catalyst unit. FIG. 13 is a sectional view of a portion of the outboard engine system for mounting of the primary catalyst unit.

In the second embodiment, a catalyst carrier 170 of a primary catalyst unit 150 includes three catalyst carrier simple substances $\mathbf{170}_1$, $\mathbf{170}_2$, and $\mathbf{170}_3$ longitudinally arranged and contained within a mesh cover $\mathbf{172}_2$ of a flexible porous bag 172. The primary catalyst unit 150 is inserted adjacent the exhaust gas communication passage 32 and the exhaust manifold 31. In the second embodiment, each of the catalyst carrier simple substances $\mathbf{170}_1$, $\mathbf{170}_2$ and $\mathbf{170}_3$ may be one of any structure in addition to those in the first embodiment. For example, the catalyst carrier simple substance which may be used is a carrier simple substance comprised of a catalyst element carried in a solid catalyst carrier formed into a porous configuration such as honeycomb from ceramics having a good heat resistance such as alumina, or a carrier simple substance comprised of a catalyst element of metal particles carried in a Ni based or Ni—Cr based metal porous carrier (the skeleton is formed into a three-dimensional mesh configuration such as sponge). The latter catalyst carrier simple substance is suitable to be used as a catalyst carrier in the system according to the present invention because of its excellent air-permeability and strength and its good catalyst reactivity.

In the second embodiment, two, three, four or more catalyst carrier simple substances may be arranged longitudinally.

Figure 14:
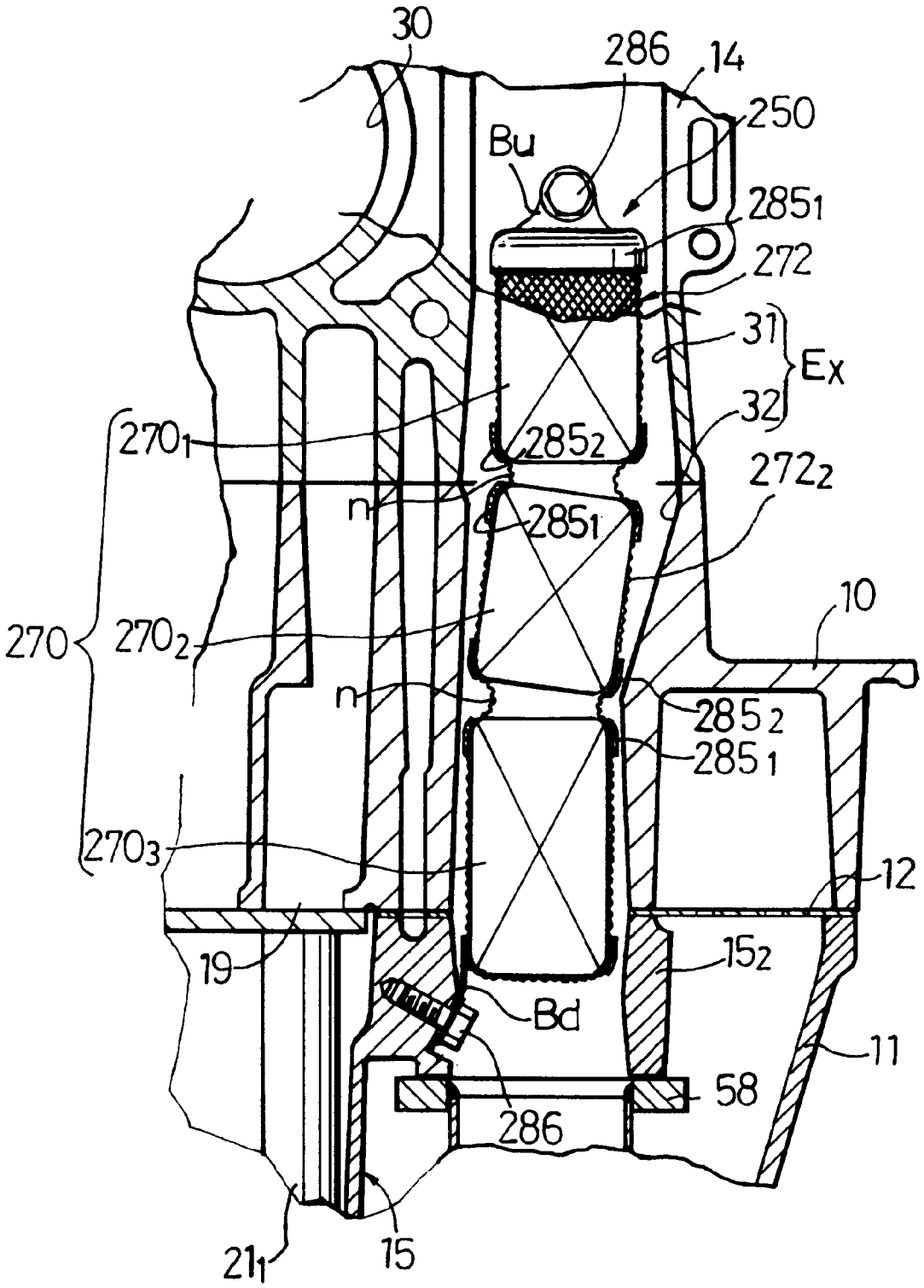
FIG. 14 is a vertical sectional view of a third embodiment of a portion of the outboard engine system at which a primary catalyst unit is mounted.
Figure 15:
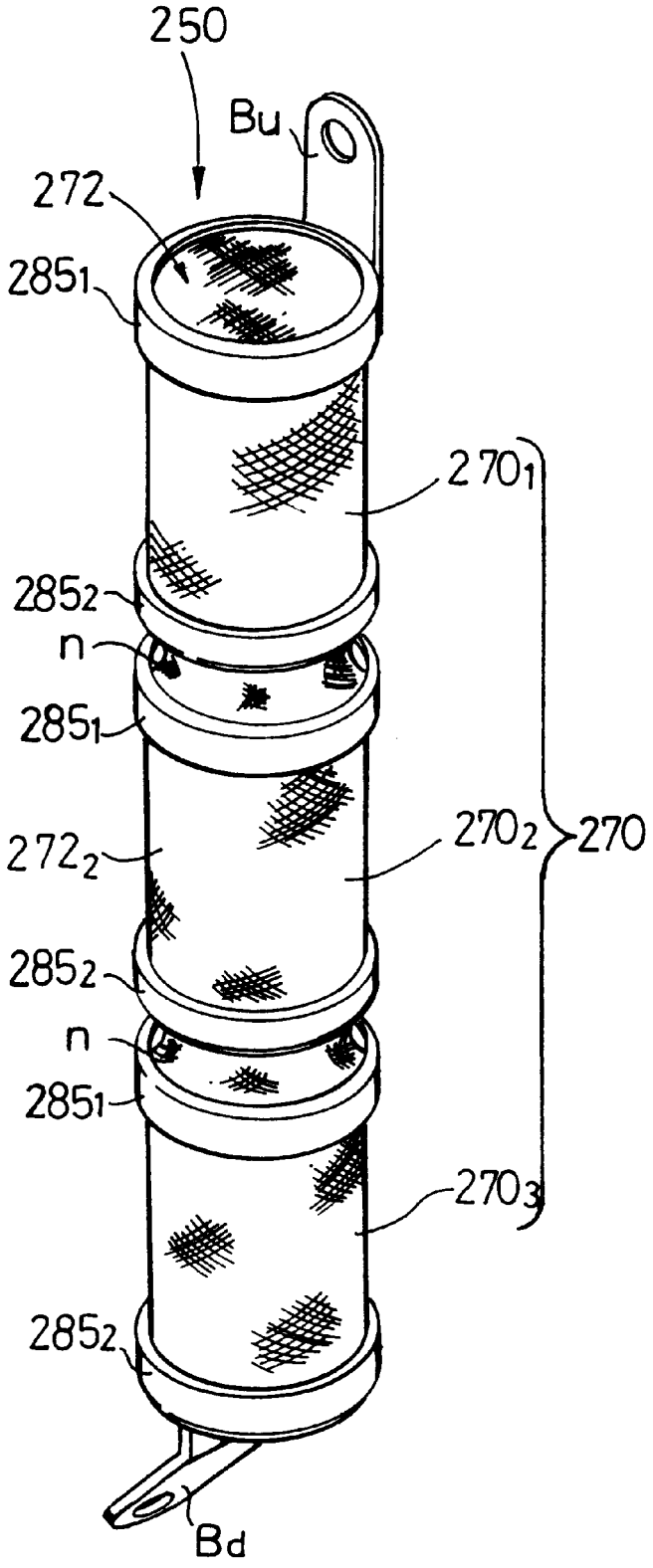
FIG. 15 is a perspective view of the primary catalyst unit in the third embodiment.

A third embodiment of the present invention will now be described with reference to FIGS. 14 and 15, wherein the same member or portions are designated by like reference numbers.

The third embodiment is slightly different from the first and second embodiments with respect to the structure of a primary catalyst unit. FIG. 14 is a sectional view of a portion of the outboard engine system where the catalyst is mounted; and FIG. 15 is a perspective view of a primary catalyst unit of the third embodiment.

In the third embodiment, a catalyst carrier 270 has three cylindrically-formed catalyst carrier simple substances $\mathbf{270}_1$, $\mathbf{270}_2$ and $\mathbf{270}_3$ longitudinally arranged and contained in a mesh cover $\mathbf{272}_2$ of a flexible porous bag 272, as in the second embodiment. However, upper and lower metal crowns $\mathbf{285}_1$ and $\mathbf{285}_2$ each having a rounded upper edge are integrally fitted over upper and lower portions of each of the catalyst carrier simple substances $\mathbf{270}_1$, $\mathbf{270}_2$ and $\mathbf{270}_3$ with the catalyst cover 272 sandwiched therebetween. Thus, the upper and lower edges of the catalyst carrier simple substances $\mathbf{270}_1$, $\mathbf{270}_2$ and $\mathbf{270}_3$ can be protected by the upper and lower metal crowns $\mathbf{285}_1$ and $\mathbf{285}_2$, and the insertion of the primary catalyst unit 250 is facilitated by the fact that the upper edges of the upper an lower metal crowns $\mathbf{285}_1$ and $\mathbf{285}_2$ are rounded. Neck members n are formed in portions of the mesh cover $\mathbf{272}_2$ corresponding to connection portions of the three catalyst carrier simple substances $\mathbf{270}_1$, $\mathbf{270}_2$ and $\mathbf{270}_3$ longitudinally arranged, so that the primary catalyst unit 250 can be flexed at these neck members n, and hence, can be easily deformed to extend along the shape of the engine block exhaust gas passage Ex. A predetermined gap is formed between the primary catalyst unit 250 and the exhaust gas passage Ex, so that exhaust gas freely flows in the exhaust gas passage Ex in both the longitudinal and lateral directions, thereby enhancing the purifying efficiency of the primary catalyst unit 250. As best shown in FIG. 15, upper and lower brackets Bu and Bd are integrally provided on the uppermost and lowermost metal crowns $\mathbf{285}_1$ and $\mathbf{285}_2$ to protrude therefrom, and are secured to the exhaust gas communication passage 32 and the exhaust manifold 31 by bolts 286, respectively. Thus, the primary catalyst unit 250 can be firmly fixed at a pre-selected position within the engine block exhaust passage Ex. Such construction enables a precise positioning of the primary catalyst unit 250 within the exhaust gas passage Ex, thereby preventing misalignment of the primary catalyst unit 250 due to external turbulence such as vibration of the engine and a back pressure of the exhaust gas.

In the third embodiment, any structure of the catalyst carrier simple substance may be employed such as in the second embodiment.

Figure 16:
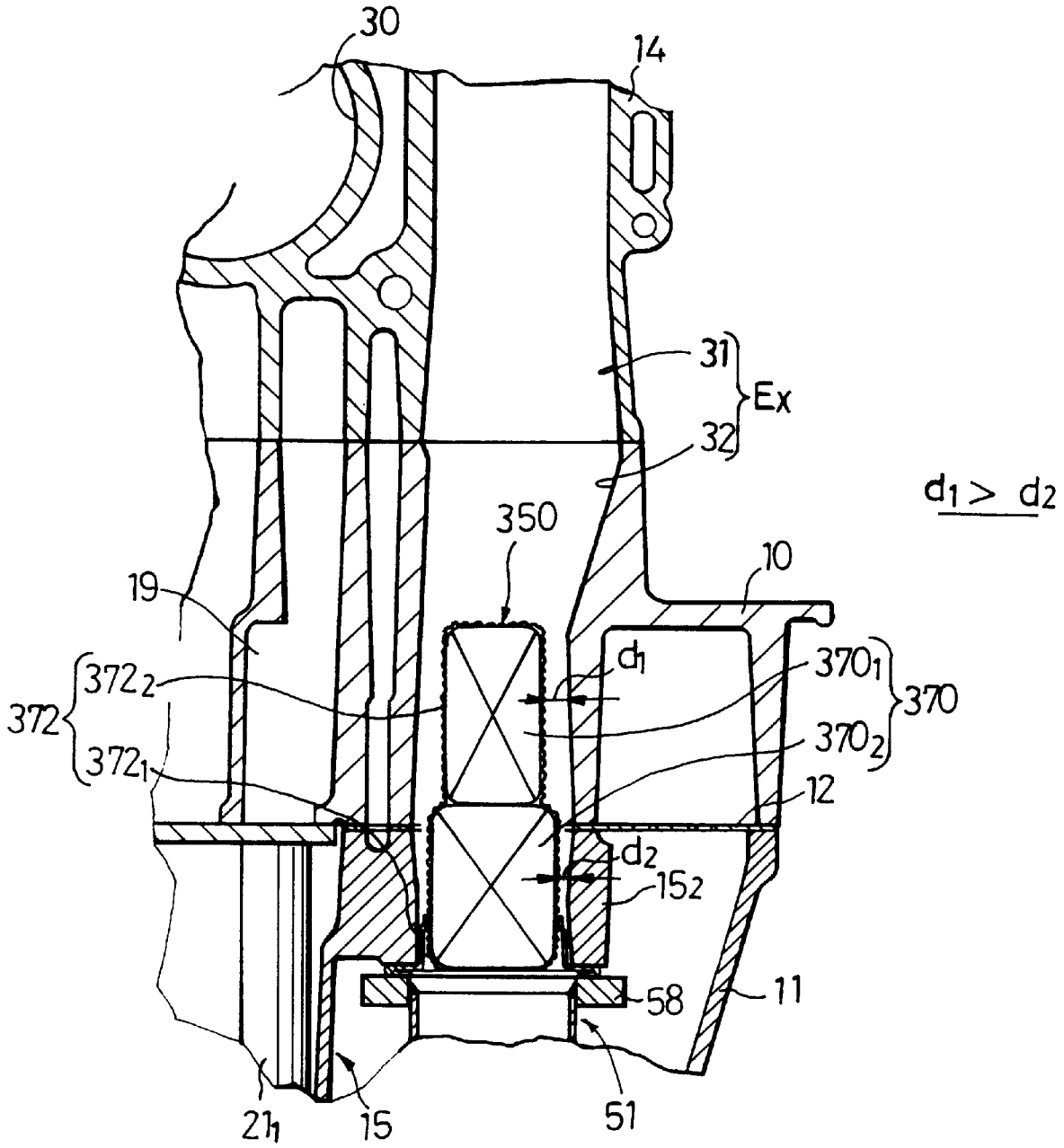
FIG. 16 is a vertical sectional view of a primary catalyst unit of a fourth embodiment of the outboard engine system.

A fourth embodiment of the present invention will now be described with reference to FIG. 16, wherein the same members or portions as those in the first to third embodiments are designated by like reference numbers.

The fourth embodiment is slightly different from the first to third embodiments in respect of the structure of a primary catalyst unit. FIG. 16 is a sectional view of a portion of an outboard engine system at which the primary catalyst unit is mounted.

In the fourth embodiment, a catalyst carrier 370 of a primary catalyst unit 350 is formed of two upper and lower cylindrically formed catalyst carrier elements $\mathbf{370}_1$ and $\mathbf{370}_2$ longitudinally arranged and contained in a mesh cover $\mathbf{372}_2$ of a flexible porous bag 372. The fourth embodiment has the feature that the diameter of the upper catalyst carrier simple substance $\mathbf{370}_1$ is slightly smaller than that of the lower catalyst carrier simple substance $\mathbf{370}_2$. The upper catalyst carrier simple substance $\mathbf{370}_1$ is disposed within the exhaust manifold 31, while the lower catalyst carrier simple substance $\mathbf{370}_2$ is disposed in the exhaust gas communication passage 32. A gap $d_1$ between the upper catalyst carrier simple substance $\mathbf{370}_1$ and an inner wall of the exhaust manifold 31 is larger than a gap $d_2$ between the lower catalyst carrier simple substance $\mathbf{370}_2$ and an inner wall of the exhaust gas communication passage 32. A difference $d_1-d_2$ between the gaps enables the back pressure of the exhaust gas to be adjusted. On the other hand, the porous bag 372 is formed by attaching an annular mounting plate $\mathbf{372}_1$ to an opened base end of the mesh cover $372_2$. The mounting plate $372_1$ has a flange portion clamped and fixed between the extension $15_1$ of the oil pan 15 and the mounting flange 58 of the secondary catalyst unit 51.

Even in the fourth embodiment, of course, any type of the catalyst carrier simple substance may be employed.

In the engine exhaust emission control system of the present invention, the catalyst unit can be removably inserted into and mounted in the engine side exhaust gas passage, irrespective of the shape of the exhaust gas passage. Therefore, the exhaust gas can be reacted and purified by the catalyst unit, while remaining at a high temperature state, and the area of contact of the catalyst carrier with the exhaust gas can be increased to remarkably enhance the purifying efficiency of the catalyst unit. In addition, it is possible to easily mount the catalyst unit in the engine side exhaust gas passage.

Although the first, second, third and fourth embodiments of the present invention have been described, it will be understood that the present invention is not limited to these embodiments and various modifications may be made within the scope of the invention defined in claims. For example, although the exhaust emission control system according to the present invention has been described as being applied to the engine for the outboard engine system in the above-described embodiments, it can be of course applied to the engine for other machines or equipment. In addition, the primary and secondary catalyst units are mounted in the exhaust system of the engine in the embodiments, but the exhaust emission control system may be formed from only a primary catalyst unit.

We claim:

1. An engine exhaust emission control system for an engine, said exhaust emission control system having a catalyst unit mounted in an engine block exhaust gas passage of said engine, said catalyst unit comprising a catalyst carrier having at least one catalyst element carried therein, and a flexible porous bag having at least a portion of catalyst carrier therein, wherein said catalyst unit is formed to be positioned within said engine block exhaust passage so as to extend therealong, wherein said catalyst unit is removably inserted and detachably mounted in said exhaust gas passage, and wherein said flexible porous bag forms an outer housing of the catalyst unit.

2. An engine exhaust emission control system as set forth in claim 1, wherein said catalyst unit is cylindrical in shape.

3. An engine exhaust emission control system as set forth in claim 1, including an engine mounting member wherein said engine is mounted on said engine mounting member; wherein said engine block exhaust gas passage comprises an exhaust manifold mounted on said engine block and an exhaust gas communication passage formed in said mounting member; and wherein said catalyst unit is positioned in said exhaust gas communication passage.

4. An engine exhaust emission control system as set forth in claim 1, including an engine mounting member wherein said engine is mounted on said engine mounting member; wherein said engine block exhaust gas passage comprises an exhaust manifold mounted on said engine block and an exhaust gas communication passage formed in said mounting member; and wherein said catalyst unit is positioned in said exhaust gas communication passage and in said exhaust manifold.

5. An engine exhaust emission control system as set forth in claim 1, including an engine mounting member wherein said engine is mounted on said engine mounting member; wherein said engine block exhaust gas passage comprises an exhaust manifold mounted on said engine block and an exhaust gas communication passage formed in said mounting member; and wherein said catalyst unit is positioned in said exhaust gas communication passage and in said exhaust manifold.

6. An engine exhaust emission control system as recited in claim 1, wherein said catalyst unit is frictionally engaged within said engine block exhaust passage.

7. An engine exhaust emission control system as recited in claim 1, wherein said catalyst unit further comprises securing means for securing the catalyst unit within said exhaust gas passage.

8. An engine exhaust emission control system in an outboard engine, said exhaust emission control system including a catalyst unit mounted in an engine block exhaust gas passage in said outboard engine, said catalyst unit comprising a catalyst carrier having at least one catalyst element carried therein, and a flexible porous bag having at least a portion of catalyst carrier therein, wherein said catalyst unit is formed to be positioned within said engine block exhaust passage so as to extend therealong, wherein said catalyst unit is removably inserted and detachably mounted in said exhaust gas passage, and wherein said flexible porous bag forms an outer housing of the catalyst unit.

9. An engine exhaust emission control system as recited in claim 8, wherein said catalyst unit is frictionally engaged within said engine block exhaust passage.

10. An engine exhaust emission control system as recited in claim 8, wherein said catalyst unit further comprises securing means for securing the catalyst unit within said exhaust gas passage.

11. An engine exhaust emission control system as set forth in claim 8, wherein said catalyst unit is cylindrical in shape.

12. An engine exhaust emission control system as set forth in claim 8, including an engine mounting member wherein said engine is mounted on said engine mounting member; wherein said engine block exhaust gas passage comprises an exhaust manifold mounted on said engine block and an exhaust gas communication passage formed in said mounting member; and wherein said catalyst unit is positioned in said exhaust gas communication passage.

13. An engine exhaust emission control system as set forth in claim 1 or 8, wherein said catalyst unit is secured to an inner wall of said engine block exhaust gas passage.

14. An engine exhaust emission control system as set forth in any one of claims 5–8, wherein said outboard engine is a 4-cycle engine having an engine block mounted on an engine mounting member, an oil pan mounted on and suspended from the lower surface of said mounting member, and an extension housing mounted on the lower surface of said mounting member, said extension housing having a gas expansion chamber formed therein, and wherein said engine block exhaust passage is in communication with an exhaust gas expansion chamber.

15. An engine exhaust emission control system as set forth in claim 1 or 8, wherein said catalyst carrier is formed of a flexible cylindrical member having threads formed in a net-like configuration and wherein said catalyst element is positioned therein.

16. An engine exhaust emission control system as set forth in claim 1 or 5, wherein said catalyst carrier is a metal porous member having a sponge-like, three-dimensional, mesh skeleton, and wherein said catalyst element is positioned therein.

17. An engine exhaust emission control system as set forth in claim 1 or 5, wherein said flexible porous bag comprises a mounting plate and a mesh cover fixed thereto.

18. An engine exhaust emission control system as set forth in claim 1 or 5, wherein said catalyst unit comprises a plurality of catalyst carrier simple substance blocks arranged longitudinally with respect to each other, said plurality of substance blocks being positioned in said flexible porous bag.

19. An engine exhaust emission control system as set forth in claim 18, wherein said flexible porous bag comprises a plurality of sections and neck members for connecting adjacent sections, and wherein said each of said sections includes at least one of said substance blocks.

20. An engine exhaust emission control system as set forth in claim 1 or 8, wherein said catalyst unit comprises a plurality of catalyst carrier simple substance blocks, oriented vertically and arranged longitudinally with respect to each other, the diameter of each of said plurality of substance blocks is greater than the diameter of the substance blocks positioned above, said plurality of substance blocks being positioned in said flexible porous bag.

* * * * *